US008807268B2

(12) United States Patent
Dodd

(10) Patent No.: US 8,807,268 B2
(45) Date of Patent: Aug. 19, 2014

(54) LOUDSPEAKER

(71) Applicant: GP Acoustics International Limited, Kwai Chung (HK)

(72) Inventor: Mark Alexander Dodd, Woodbridge (GB)

(73) Assignee: GP Acoustics International Limited, Kwai Chung (HK)

( * ) Notice: Subject to any disclaimer, the term of this patent is extended or adjusted under 35 U.S.C. 154(b) by 0 days.

(21) Appl. No.: 13/864,561

(22) Filed: Apr. 17, 2013

(65) Prior Publication Data

US 2013/0277140 A1 Oct. 24, 2013

(30) Foreign Application Priority Data

Apr. 17, 2012 (GB) ..... 1206729.4

(51) Int. Cl.

| | |
|---|---|
| ***H04R 1/02*** | (2006.01) |
| ***H04R 1/20*** | (2006.01) |
| ***H04R 5/00*** | (2006.01) |
| ***H04R 1/28*** | (2006.01) |

(52) U.S. Cl.

CPC ..... *H04R 5/00* (2013.01); *H04R 1/288* (2013.01); *H04R 1/2823* (2013.01)

USPC ..... 181/156; 381/349

(58) Field of Classification Search

USPC ..... 181/148, 156, 199, 155; 381/338, 345, 381/349

See application file for complete search history.

(56) References Cited

U.S. PATENT DOCUMENTS

| | | | | |
|---|---|---|---|---|
| 1,869,178 | A * | 7/1932 | Thuras | 181/160 |
| 3,037,081 | A * | 5/1962 | Carlsson | 381/336 |
| 4,231,445 | A * | 11/1980 | Johnson | 181/148 |
| 4,284,166 | A * | 8/1981 | Gale | 181/156 |
| 4,741,040 | A * | 4/1988 | Kaizer | 381/103 |
| 4,997,057 | A * | 3/1991 | Furukawa | 381/96 |
| 5,115,884 | A * | 5/1992 | Falco | 181/156 |
| 5,173,575 | A * | 12/1992 | Furukawa | 381/96 |
| 5,623,132 | A * | 4/1997 | Gahm | 181/156 |
| 5,693,916 | A * | 12/1997 | von Sprecken | 181/156 |
| 5,696,357 | A * | 12/1997 | Starobin | 181/156 |
| 6,324,292 | B1 | 11/2001 | Mitsuhashi et al. | |
| 6,597,795 | B1 * | 7/2003 | Swenson | 381/349 |
| 6,665,413 | B1 * | 12/2003 | Domen | 381/349 |
| 6,735,320 | B1 * | 5/2004 | Gertner, Jr. | 381/349 |
| 2003/0076975 | A1 * | 4/2003 | Stead et al. | 381/345 |

(Continued)

FOREIGN PATENT DOCUMENTS

| | | | |
|---|---|---|---|
| WO | 9708916 | A1 | 3/1997 |
| WO | 2008025060 | A1 | 3/2008 |

OTHER PUBLICATIONS

GB Search Report; GB1206729.4; Jun. 8, 2012.

*Primary Examiner* — Jeremy Luks

(74) *Attorney, Agent, or Firm* — Westerman, Champlin & Koehler, P.A.; Z. Peter Sawicki; Amanda Prose

(57) ABSTRACT

A loudspeaker comprises a reflex port located within the enclosure at a point substantially co-incident with a nodal surface of at least one resonant mode within the enclosure. The amplitude of that resonance at the input to the duct is minimized, hence assisting in filtering out the effect of that resonance without needing absorptive material. Ideally, it is placed at the intersection of two or more nodal surfaces.

10 Claims, 3 Drawing Sheets

(56) References Cited

U.S. PATENT DOCUMENTS

2003/0156728 A1* 8/2003 Chatani et al. ..... 381/345
2005/0072624 A1 4/2005 Hwan Ryu et al.
2005/0175206 A1* 8/2005 Bearden ..... 381/338

* cited by examiner

LOUDSPEAKER

CROSS-REFERENCE TO RELATED APPLICATIONS

This application claims priority to GB Application No. 1206729.4, filed on Apr. 17, 2012, the content of which is hereby incorporated by reference in its entirety.

FIELD OF THE INVENTION

The present invention relates to loudspeakers.

BACKGROUND ART

A "bass reflex" loudspeaker (also known as a ported, vented box or reflex port loudspeaker) is a type of loudspeaker with an enclosure that uses the sound from the rear side of the diaphragm to increase the efficiency of the loudspeaker at low frequencies as compared to a typical closed box loudspeaker. Such loudspeakers employ a reflex port, which generally consists of one or more ducts mounted in the front face (baffle) or rear face of the enclosure, leading from the air volume behind the driver to the external air.

This results in a Helmholtz resonance that combines with the loudspeaker output to give additional low frequency output. In the simplest terms the air in the enclosure behaves as an acoustic compliance which combines with the acoustic mass of the air in the duct to form an acoustic bandpass filter. The acoustic output from the rear of the driver passes through this filter and combines with the output from the front of the driver. For a particular low frequency driver the box volume and duct dimensions are typically chosen to give a response which has the characteristics of a fourth order high-pass filter.

Reflex systems are widely used since they provide better combination of efficiency and low frequency extension compared to closed box systems. They also have the benefit of reducing the diaphragm excursion at frequencies around the enclosure tuning frequency where the duct provides the main acoustic output. Though helpful with extending bass performance, bass reflex cabinets can have poor transient response compared to sealed enclosures at frequencies near the lower limit of performance. Proper adjustment of the cabinet and port size, and matching with driver characteristics are the typical approaches used to address this problem.

SUMMARY OF THE INVENTION

However, while the output from the duct at the box tuning frequency is desirable, output above this frequency may cause unwanted frequency response aberrations. We have found that where the wavelength in the upper part of the frequency range becomes small compared to the dimensions of the enclosure, the air volume cavity modes affect the behaviour and the air volume no longer behaves as an acoustic compliance. At these modal frequencies output from the rear of the driver produces peaks in the frequency response of the air pressure in the box. The level of these peaks may be sufficiently high for sufficient sound to be transmitted through the duct to cause response aberrations and the corresponding tonal distortion.

One response to these cavity modes might be to add acoustic absorptive material such as foam, fibreglass or wool, to reduce their magnitude. However, reflex enclosures require low acoustic losses in order to achieve good efficiency and extension. In practice, adding sufficient absorptive material to eliminate the effects of these cavity resonances is not possible without also incurring a severe loss of low frequency output, thereby negating the benefits of a reflex enclosure.

The present invention therefore provides a loudspeaker comprising an enclosure, a driver located substantially within the enclosure and including a diaphragm able to oscillate along an axis, and a reflex port consisting of a duct extending from a first location within the enclosure to a location external to the enclosure, the first location being substantially coincident with a nodal surface of at least one resonant mode within the enclosure.

By placing the free end of the reflex duct within the enclosure at a nodal surface, the amplitude of the resonance at the input to the duct is minimised, hence assisting in filtering out the effect of that resonance without needing absorptive material.

Typically, there will be a number of resonances that are to be avoided. The first location can thus be placed at the intersection of two or more nodal surfaces. Candidate placements for the first locations include:

- an even-order nodal surface of the resonant mode existing within the enclosure in that x-direction, where x, y and z are mutually perpendicular axes and the z axis is substantially aligned with the diaphragm axis.
- an even-order nodal surface of the resonant mode existing within the enclosure in the y-direction.
- a nodal surface of the resonant mode existing within the enclosure in the z-direction.

In a specific implementation, one, some or all of these locations can be selected. As each is a surface lying generally transverse to one of the respective three axes, all three can be selected thus dictating a number of specific placements for the first location. Typically there will be more than one possible location as resonances higher than the first-order resonance may have more than one nodal surface.

Loudspeaker enclosures typically comprise a substantially flat baffle or front face, on which the driver is mounted. The location external to the enclosure is preferably an external face of the baffle. We also prefer that the duct extends perpendicularly away from an inner face of the baffle into the interior of the enclosure.

Where the enclosure also comprises a substantially flat rear face, which will then be spaced from and opposite the baffle, the first location can then be spaced substantially equidistant between the baffle and the rear face as this will usually correspond to the first-order and strongest resonance in the z-direction.

Many enclosures comprise (or also comprise) a pair of side walls extending rearwardly from the baffle, transversely thereto, in which case the first location can be positioned at a point substantially one quarter of the distance from one side wall to the other side wall along a direction perpendicular to the diaphragm axis. This will correspond to the nodal surface of even-order resonances in that direction. Enclosures often take a substantially rectangular form, in which case there will be a second pair of side walls extending rearwardly from the baffle, transversely to the baffle and to the first pair of side walls, and we then prefer that the first location is positioned at a point substantially one quarter of the distance from one second side wall to the other second side wall along a direction perpendicular to the diaphragm axis, for the same reason.

Typically, the duct is straight, for ease of manufacture. However, in order to accommodate the positional requirements of the invention, it may be appropriate in some cases to provide a non straight duct, i.e. one that includes curved or angular sections.

BRIEF DESCRIPTION OF THE DRAWINGS

An embodiment of the present invention will now be described by way of example, with reference to the accompanying figures in which.

DETAILED DESCRIPTION OF THE EMBODIMENTS

Historically, little or no attention has been paid to cavity modes within the enclosure in the design of reflex loudspeakers. Typically, if thought has been given to the question of the physical layout of the components, baffle diffraction has been the main consideration in which case the driver is usually placed away from a plane of symmetry. In some cases, where stereo image is a major consideration, the enclosures are then 'handed' by providing left and right hand enclosures which are mirror images. Most effort in relation to cavity modes is to eliminate or reduce them, such as by the use of non-parallel sides for the enclosure or by the use of internal deadening material.

More usually, the driver central axis is positioned approximately ⅔ of the way up the enclosure in a central position with the aim of exciting the vertical modes an equal amount. In some cases, particularly where the driver is of a coaxial type, the driver is mounted centrally on the baffle at the intersection of the horizontal and vertical planes of symmetry. This position coincides with the nodal surfaces of the first vertical and horizontal modes, so these are not excited. There are also many higher order modes, often referred to as odd order modes with nodal surfaces intersecting the centre of the baffle, which are also not excited by a driver thus located.

Figure 1:
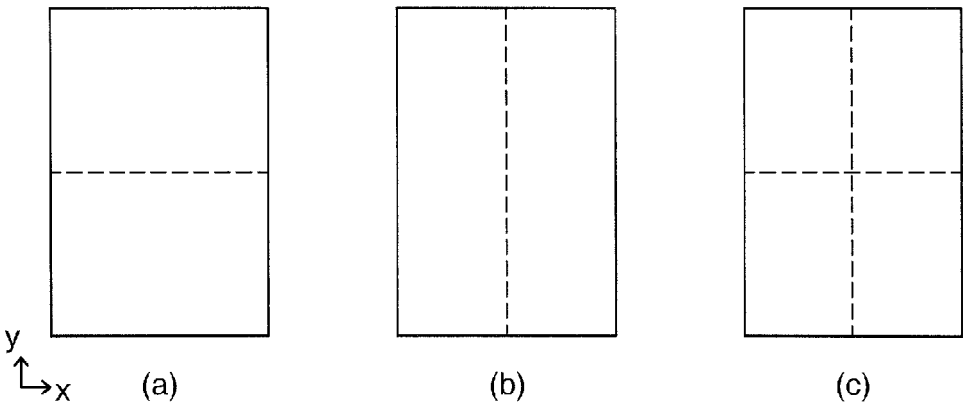
FIG. 1 shows the odd order nodal planes in a rectangular air volume.

It is especially useful to reduce the level of the lowest frequency modes, since they require the largest amount of absorptive material which leads to correspondingly large losses in bass output if they are damped to reduce their level. FIG. 1 shows these lowest-frequency modes in a bounded rectangular air volume, viewed from the front. The nodal surfaces, which in this case are planes, are represented by dotted lines. FIG. 1(*a*) shows the nodal plane of the first vertical mode (i.e. in the y direction); this plane extends horizontally across the enclosure at the mid-point. FIG. 1(*b*) shows the nodal plane of the first horizontal mode (i.e. in the x direction); this plane extends vertically down the enclosure, at the middle. FIG. 1(*c*) shows the nodal planes of the next odd-order mode, existing in the x-y plane, and which (in this case) consists of two nodal planes, one vertical and one horizontal, meeting at the centreline of the enclosure. That centreline is common to the nodal planes of all three modes, and thus a driver positioned such that its axis substantially coincides with this centreline will therefore not substantially excite any of the three modes shown.

Other modes will however be excited, specifically the modes that exist in the planes parallel to the driver axis (whose nodal planes will be perpendicular to the driver axis), and the even-order modes in the plane perpendicular to the driver axis.

The modes whose nodal planes are perpendicular to the driver axis cannot be avoided through merely adjusting the position of the driver. However, the strongest of those modes, the fundamental or first-order mode, will have a nodal plane within the enclosure, usually midway between the baffle (the front face of the enclosure on which the driver is mounted) and the rear face of the enclosure. This nodal plane will also be shared with the remaining odd-order modes (i.e. the $3^{rd}$, $5^{th}$, $7^{th}$, etc.). Thus, whilst these modes will be excited, we can avoid them having an effect on the reflex port by locating the free end of its duct at that nodal plane. This will minimise the amplitude at the duct opening.

This leaves the even-order modes (i.e. the $2^{nd}$, $4^{th}$, etc). Those existing in the plane parallel to the driver axis, i.e. with nodal planes perpendicular to the driver axis, cannot be avoided. However, the even-order modes existing in the plane perpendicular to the driver axis, i.e. with nodal planes parallel to the driver axis, can be dealt with as follows.

Figure 2:
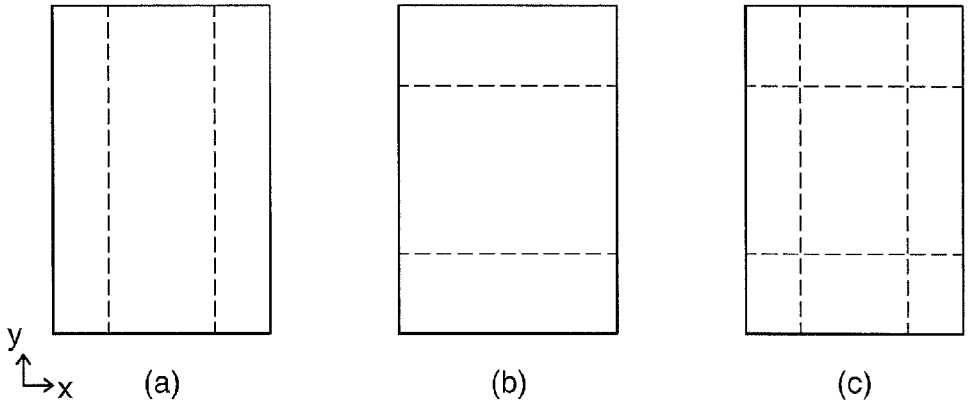
FIG. 2 shows the singly even order nodal planes in a rectangular air volume.

With reference to FIG. 2, if the driver is centrally positioned on the front wall of the enclosure then, as discussed above, the horizontal and vertical odd-order modes (i.e. with waves travelling in the plane of the driver, perpendicular to its axis) are not excited. However the even order modes are excited. According to the present invention, these are dealt with by appropriate placement of the duct instead of by placement of the driver. If we firstly consider just the even order modes due to waves travelling in the plane of the driver, then the nodal surfaces for the first vertical and first horizontal even order modes intersect on four curves (or, in the case of a rectangular box, lines).

FIG. 2(*a*) shows the nodal surfaces of a second-order mode in the x-direction of a rectangular enclosure, which consist of two vertical parallel planes each spaced midway between the plane bisecting the enclosure and the end faces—i.e. each spaced from an enclosure wall by one quarter of the enclosure width. FIG. 2(*b*) shows the nodal surfaces of a second-order mode in the y-direction of a rectangular enclosure, which consist of two horizontal parallel planes, correspondingly located. FIG. 2(*c*) shows the nodal planes of the next even-order mode, existing in the x-y plane, and which (in this case) consists of four nodal planes, two vertical and two horizontal, all spaced one-quarter of the relevant enclosure dimension from the enclosure wall. The intersections of all these planes define four lines, oriented into the page of FIG. 2, located at the four quarter points of the enclosure, i.e. the four points that are spaced from the edges of the enclosure by a distance that is one-quarter of the enclosure dimension in that direction.

If the duct entrance inside the enclosure is positioned on these curves (or lines) then these even-order modes will not produces peaks in the response at the entrance of the duct, and consequently these modes will not be transmitted through the duct.

As noted above, considering a wave travelling along the driver axis into the enclosure then all these modes are excited regardless of the driver position. The best we can achieve is to positioning the duct on the first mode's nodal surface, thus avoiding the effect of the first (and strongest) mode, together with any modes sharing that nodal surface. For a rectangular enclosure the first nodal surface is a plane parallel to the front of the enclosure and bisecting the enclosure volume.

The intersection of this surface with the curves from considering horizontal and vertical modes gives four points in the enclosure at which the mode amplitude of the first few modes will be minimum. For a rectangular box enclosure with a negligibly-sized driver, these four points will be the four quarter points on the plane perpendicular to the driver axis, bisecting the enclosure depth. For other enclosure shapes, the four points will be a function of the acoustic properties of the enclosure, revealed by appropriate finite-element modelling (FEM).

For shallow enclosures the frequency of the first mode along the axis of the driver may be sufficiently high not to require suppression, so the duct entrance may not need to be on the nodal surface passing through the driver axis. In other cases the acoustic absorptive material may be distributed to primarily suppress the mode along the driver axis, also reducing the need to position the duct entrance on the nodal surface passing through the driver axis.

It is worth noting that in practice the nodal surfaces predicted by FEM of a complete loudspeaker enclosure are not all planar, especially the mode travelling from front to back, since the volume occupied by driver alters the geometry of the air. In some cases the enclosure may have one or more non-planar or non-parallel surfaces. In such cases FEM may be used to predict the nodal surfaces, and the invention applied to the modelled nodal surfaces according to the principles set out above.

Figure 3:
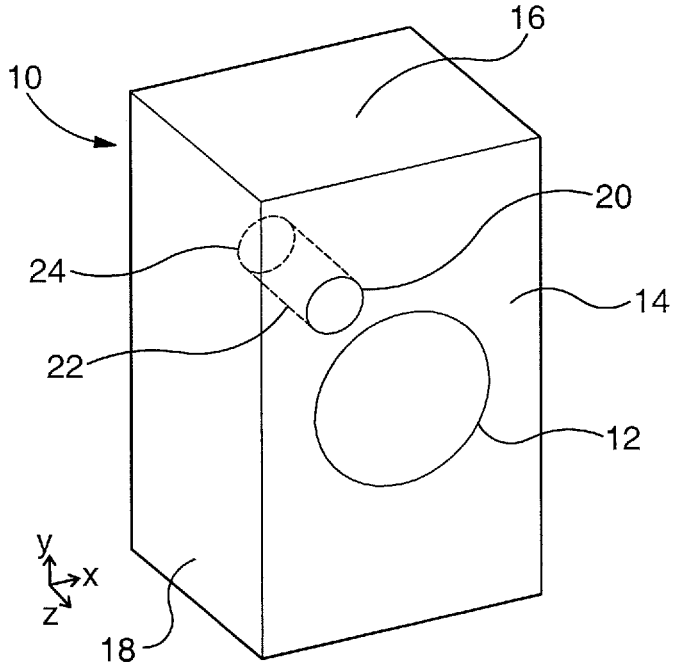
FIG. 3 shows an example loudspeaker design according to the present invention, with a single reflex duct.

FIG. 3 shows a simple example of a design for a loudspeaker 10 according to the present invention with a single reflex duct. The driver 12 is located at the midpoint of the rectangular baffle 14. Four side walls 16, 18 and a rear wall complete a rectangular enclosure for the loudspeaker 10. A reflex port 20 is provided on the baffle 14, located at the upper left quarter point of the baffle 14, i.e. displaced downward from the upper edge of the baffle by a distance of one-quarter of the height of the baffle 14 and spaced inward from the left edge of the baffle 14 by a distance of one-quarter of the width of the baffle 14. Behind the reflex port 20, a duct 22 extends perpendicularly to the baffle 14 into the enclosure by a distance equal to one-half of the depth of the enclosure, ending at an open inlet 24.

That inlet 24 is therefore located as instructed above, at the point of intersection of the nodal surfaces of odd-order modes in the z-direction and even-order modes in the x and y directions. Odd-order modes in the x and y directions are suppressed by the location of the driver 12. This leaves only the even-order modes in the z-direction, a significant reduction of the potential sources of cavity resonance.

Figure 4:
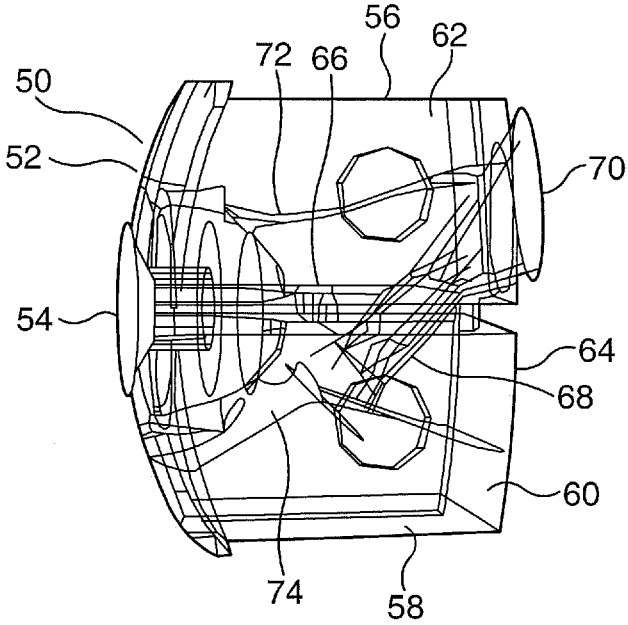
FIG. 4 shows an alternative loudspeaker design according to the present invention.

FIG. 4 shows a more complex design of loudspeaker 50, in combination with the results of FEM. The baffle 52 is a convex compound curve with the driver 54 located at its midpoint. A rectangular vertical section for the loudspeaker is provided by planar parallel horizontal upper and lower walls 56, 58 and by planar parallel vertical side walls 60, 62. The rear face 64 of the loudspeaker 50 is slightly convex, although less so than the baffle 52.

Within the loudspeaker enclosure thus defined, an internal shelf 66 assists in controlling the vibration from the driver 54. A reflex duct 68 extends from a reflex port 70 on the rear face 64 to a location within the enclosure. These structures, and the non-linear nature of the baffle 52 and rear face 64, mean that the perfect symmetry of the design of FIG. 3 is not present and hence the nodal surfaces are not planar.

An FEM analysis of the enclosure does however reveal the nodal surfaces of the cavity resonances. Such FEM models are available and provide generally accurate analysis of such factors, usually employed with a view to suppressing cavity resonances or in determining where deadening material should be located and in what quantity. FIG. 4 shows the nodal surfaces 72, 74 of a resonance in the vertical direction, which are distinctly non-planar and non-parallel as a result of the asymmetries of the enclosure. The reflex duct 68 is however oriented and located so that its free end meets the lower nodal surface 74.

Similar FEM analysis will reveal the other nodal surfaces described above, and these will dictate where the duct 68 should meet the nodal surface 74. To an extent, the shape, orientation and position of the duct 68 will affect the FEM analysis and hence will influence the shape of the nodal surfaces, so a degree of iteration is likely to be needed to arrive at a solution.

Figure 5:
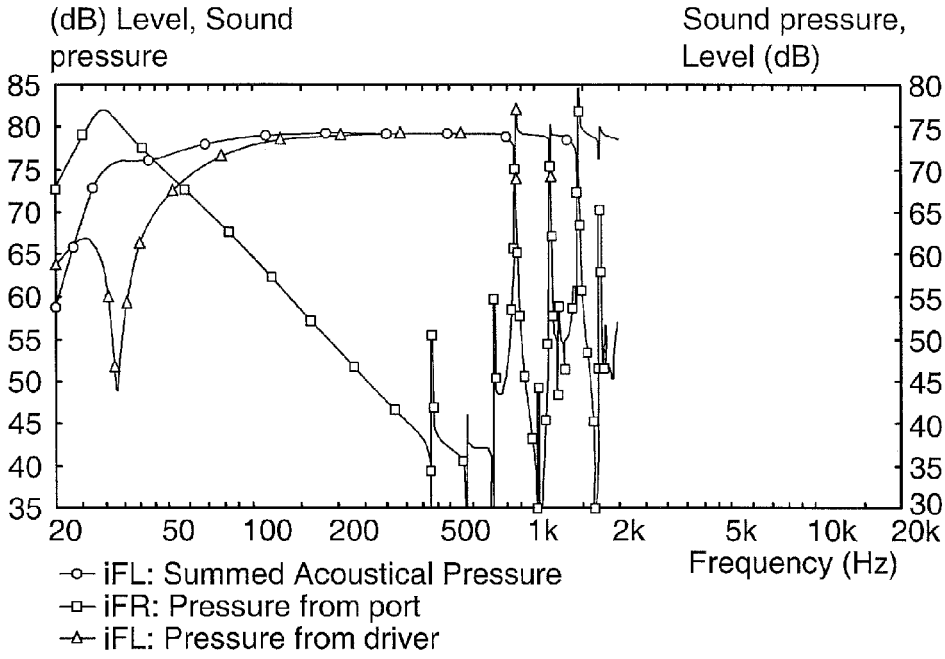
FIG. 5 shows the frequency response of a shallow enclosure with the port and driver in a known location.
Figure 6:
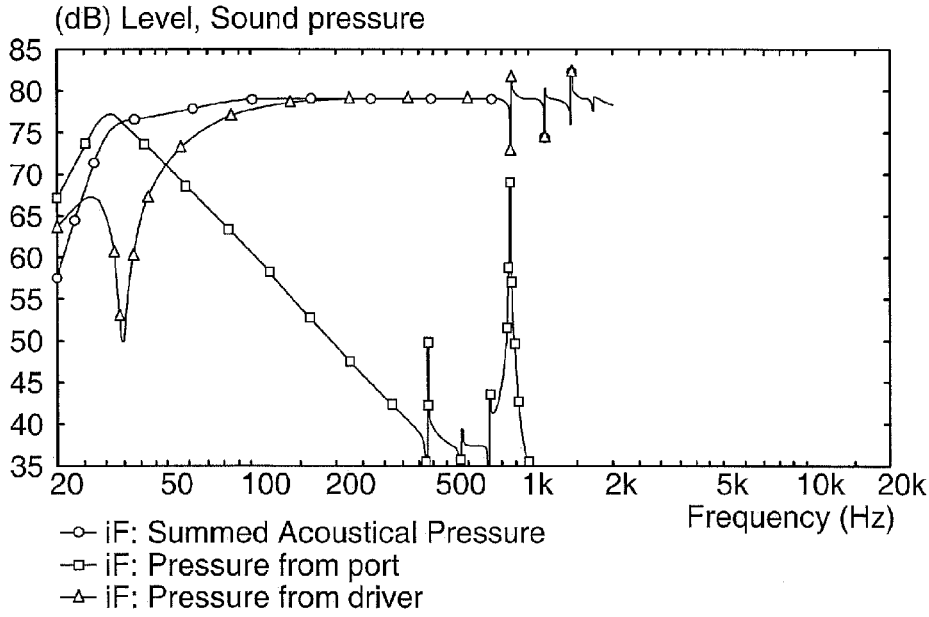
FIG. 6 shows the frequency response of a shallow enclosure with the port located according to the present invention.

FIGS. 5 and 6 show the comparative results with and without the invention, for a shallow enclosure. FIG. 5 shows the frequency response with the driver in a central position on the baffle and the reflex port located in a corner. It can be seen that there is a beneficial effect from the port up to about 300 Hz, with the sound pressure from the port (shown by the line joining the square points) compensating for the reduced sound pressure from the driver (line joining triangular points) and producing an overall sound pressure (line joining circular points) that is very flat from about 30-40 Hz upwards. However, there are a number of spikes in the frequency response of the port from about 300 Hz upwards, corresponding to cavity resonant modes.

FIG. 6 shows the frequency response of the same shallow enclosure, but with the port and driver located in the positions called for by the present invention, i.e. with the driver located centrally and the port spaced from the enclosure edge by ¼ of the horizontal and vertical dimensions. Whereas some spikes remain in the region over 300 Hz, corresponding to the resonant modes that cannot be eliminated, the majority of the spikes are eliminated without any detrimental effect on the sub-300 Hz response.

It will of course be understood that many variations may be made to the above-described embodiment without departing from the scope of the present invention.

What is claimed is:

1. A reflex port loudspeaker, comprising an enclosure, a driver located substantially within the enclosure and including a diaphragm able to oscillate along an axis, this axis being the z axis of a mutually perpendicular set of x, y and z axes, and a reflex port which comprises a duct extending from a first location within the enclosure to a location external to the enclosure, the first location being substantially co-incident with a nodal surface of at least one resonant mode within the enclosure, the first location being substantially co-incident along an x-direction with an even-order nodal surface of the resonant mode existing within the enclosure in that x-direction.

2. The reflex port loudspeaker according to claim 1 in which the first location is also substantially co-incident along a y-direction with an even-order nodal surface of the resonant mode existing within the enclosure in that y-direction.

3. The reflex port loudspeaker according to claim 1 in which the first location is substantially co-incident along a z-direction with a nodal surface of the resonant mode existing within the enclosure in that z-direction.

4. The reflex port loudspeaker according to claim 1, wherein the enclosure comprises a substantially flat baffle on which the driver is mounted.

5. The reflex port loudspeaker according to claim 4 in which the driver is mounted centrally on the baffle.

6. The reflex port loudspeaker according to claim 4 in which the location external to the enclosure is an external face of the baffle.

7. The reflex port loudspeaker according to claim 6 in which the duct extends perpendicularly away from the baffle.

8. The reflex port loudspeaker according to claim 4, wherein the enclosure further comprises a substantially flat rear face spaced from and opposing the baffle, the first location being spaced substantially equidistant between the baffle and the rear face.

9. The reflex port loudspeaker according to claim 4, wherein the enclosure further comprises a pair of side walls extending rearwardly from the baffle, transversely thereto, the first location being positioned at a point substantially one quarter of the distance from one side wall to the other side wall along a direction perpendicular to the diaphragm axis.

10. The reflex port loudspeaker according to claim 9 wherein the enclosure further comprises a second pair of side walls extending rearwardly from the baffle, transversely to the baffle and to the first pair of side walls, the first location being positioned at a point substantially one quarter of the distance from one second side wall to the other second side wall along a direction perpendicular to the diaphragm axis.

* * * * *